US005875789A

United States Patent [19]

Shigihara

[11] Patent Number: 5,875,789

[45] Date of Patent: Mar. 2, 1999

[54] ULTRA-SONIC PERMING DEVICE AND METHOD

[75] Inventor: Takanori Shigihara, Ashiya, Japan

[73] Assignee: Eroica Corporation, Ashiya, Japan

[21] Appl. No.: 945,804

[22] PCT Filed: May 9, 1996

[86] PCT No.: PCT/JP96/01226

§ 371 Date: Jan. 9, 1998

§ 102(e) Date: Jan. 9, 1998

[87] PCT Pub. No.: WO96/35350

PCT Pub. Date: Nov. 14, 1996

[30] Foreign Application Priority Data

May 12, 1995 [JP] Japan ..... 7-114775

[51] Int. Cl.[6] ..... A45D 7/00; A45D 2/36

[52] U.S. Cl. ..... 132/210; 132/226

[58] Field of Search ..... 132/210, 211, 132/226, 227, 229, 232, 269

[56] References Cited

U.S. PATENT DOCUMENTS

| | | | |
|---|---|---|---|
| 3,211,159 | 10/1965 | Goble | 132/210 |
| 4,023,579 | 5/1977 | Suroff | 132/272 |
| 4,426,567 | 1/1984 | Gugliotti | 132/232 |
| 4,691,095 | 9/1987 | Barowski et al. | 132/229 |
| 5,487,396 | 1/1996 | Wilson | 132/210 |

FOREIGN PATENT DOCUMENTS

| | | | |
|---|---|---|---|
| 61-196951 | 9/1986 | Japan . | |
| 63-103801 | 7/1988 | Japan . | |
| 94/026142 | 11/1994 | WIPO | 132/210 |

*Primary Examiner*—Todd E. Manahan

*Attorney, Agent, or Firm*—Oblon, Spivak, McClelland, Maier & Neustadt, P.C.

[57] ABSTRACT

This invention provides a method for altering hairs by bringing the hairs into contact with an elastic body vibrating ultrasonically. At first, alternate vibrations are generated on a rod portion (i.e. a cylindrical elastic body). The cylindrical shaped elastic body does not rotate at that time. However, when an object is in contact with the surface of the cylindrical shaped elastic body, the object is rotated. Further when the object is kept stationary, the object is squeezed by spiral vibrations. Upon the hairs being in contact with the circumferential surface of the cylindrical shaped elastic body, the contacting part of the hairs are squeezed in a circumferential direction by the vibrations of the cylindrical shaped elastic body. As a result, the cross-section of each hair is deformed and remains so deformed such that perming of the hair is completed.

14 Claims, 8 Drawing Sheets

ULTRA-SONIC PERMING DEVICE AND METHOD

BACKGROUND OF THE INVENTION

Field of the Invention

This invention relates to a method and device for making permanent waved hair.

DISCUSSION OF THE BACKGOUND

Heretofore, there have been two types of a hair perming method such as a heating applied type and a chemical agent (perming agent) applied type.

According to the former type, hair texture is changed by a hot iron or an electrical iron in order to obtain and keep waved hair permanently.

According to the latter type called cold-wave, first liquid acts on hairs wound around rods as reducing agent so as to cut cystine bonds in the hairs. Thereby, the hairs lose their elasticity. Then, a second liquid acts on the hairs which have lost their elasticity as oxidizing agent so as to restore the cystine bonds. Thereby, the waved hairs are solidified.

However, in the conventional method of applying heat, a customer must be sit under a hot electrical heater for a long period of time. Therefore, a great deal of patience is necessary when a customer obtains permanent waved hair. Further, there are problems in that a customers' hair is sometimes seriously damaged and the skin on their head is sometime burned.

In the conventional method of applying perming agents, care in following the directions for use and quantity is necessary when handling the perming agents. This is because it is dangerous to handle the perming agents erroneously. For example, when the reducing agent acts on hairs too much, the cystine bonds can not be restored in the hairs. As a result, then the hairs die.

Also, when oxidation of the hairs by the oxidizing agent is not complete, the hairs are damaged without obtaining a sufficient permanent waved hairs. Further, when the perming agents stick on the skin, skin problems may be caused. Also, there is a problem in that the skin or health of not only a customer but also a hairdresser handling the perming agents are affected when the perming agents are erroneously applied.

And when the perming agents stick to the hairs, the hairs become easily charged with static electricity and then dust easily adheres to the hairs. Therefore, the hairs undergo shampooing and rinsing repeatedly such that then lipids of the hairs are damaged.

In addition, an influence on the environment caused by a large consumption of water cannot be ignored. This invention has been made to solve the above-mentioned problems. The objects of the invention are to provide a method and device for perming a hair which can perm the hair easily and safely in a short time and with very little adverse effect on the hair.

DISCLOSURE OF INVENTION

This invention provides a method for altering hairs by bringing the hairs into contact with an elastic body vibrating ultrasonically.

In more detail, the invention provides a perming method for altering hairs by pressing the hairs to the surface of the above-mentioned elastic body shaped cylindrically and vibrated ultrasonically in advance.

The device of the invention, which is one of the devices suitable for embodying the above-mentioned perming method, comprises a rod constructed with a cylindrical shaped elastic body onto which the hairs are pressed, an ultrasonic transducer for transmitting ultrasonic vibrations to the rod which is elastically coupled with the ultrasonic transducer.

When the ultrasonic vibration are applied to the rod, they are transmitted spirally around the surface of the rod. When hairs are in contact with the rod, the hairs are squeezed by ultrasonic vibrations of the rod, then altered so as to be permanently waved.

Hereinbelow, the term perming includes setting hairs so as to be waved and resetting of the hairs so as be straight. The invention can provide method and device for safely perming the hairs very easily in a very short time without spoiling hair and skin.

Furthermore, it is possible to change the hair style many times in a day since setting and resetting waves of hair can be conducted easily in a short period of time. Accordingly, it is possible to perm the hairs with such a light sense as changing clothes.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DISCUSSION OF THE PREFERRED EMBODIMENTS

Figure 1:
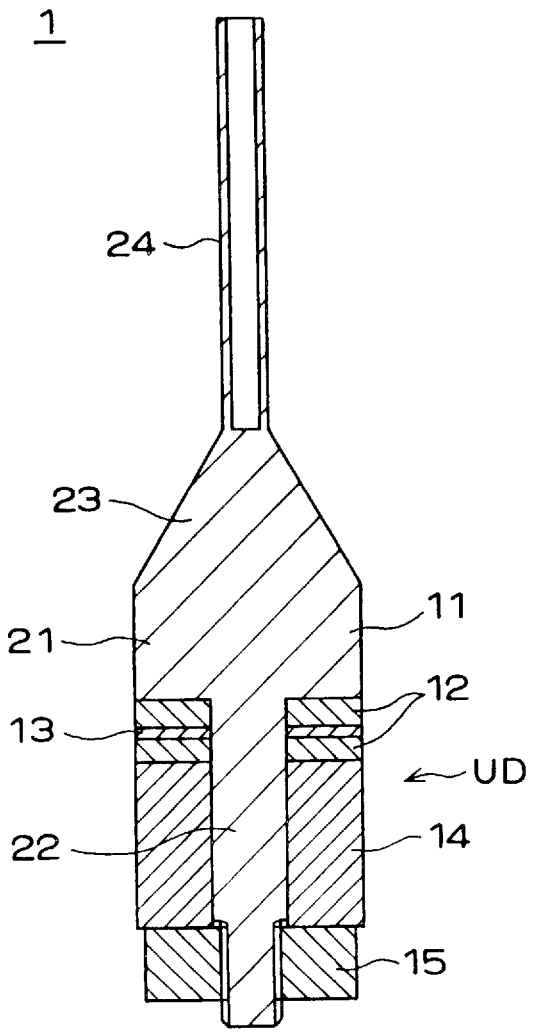
FIG. 1 is a cross-sectional frontal view of a perming device in which the invention is embodied.
Figure 2:
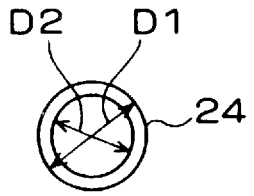
FIG. 2 is a plan view of a rod portion.
Figure 3:
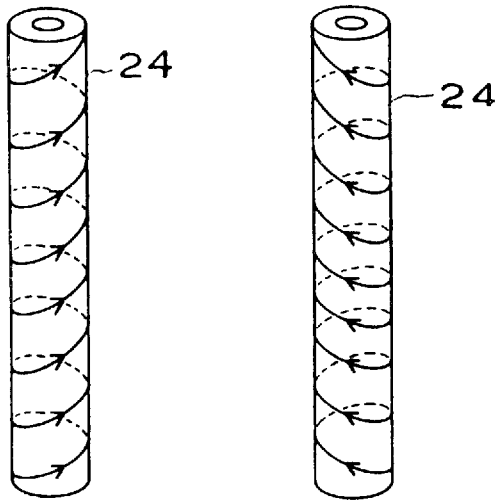
FIGS. 3(A) and 3(B) are drawings showing vibrating states of the rod portions.
Figure 4:
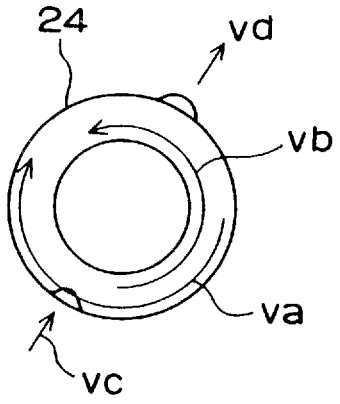
FIG. 4 is a drawing describing deformations caused to the rod by vibrations.

FIG. 1 is a cross-sectional view from the front of a perming device 1 in which the invention is embodied, FIG. 2 is a plan view of a rod portion 24, FIGS. 3(A) and 3(B) are drawings showing vibrating states of the rod portions, and FIG. 4 is a drawing describing deformations caused to the rod by vibrations. Referring to FIG. 1, the perming device comprises a main body 11, piezoelectric ceramic plates 12 each having a hole in the center thereof, an electrode plate 13, a metal block 14, a nut 15 and the like.

The main body 11 is made of titanium alloy, duralumin, aluminum alloy, steel or the like, and is shaped by a machinery cut from a material shaped cylinderically. The main body 11 has a cylinder portion 21, a shaft portion 22 having threads around its surface, a horn portion 23 and a rod portion 24.

The cylinder portion 21 has approximately the same diameter as of the piezoelectric ceramic plates 12 and further has the shaft portion 22 in the center of its bottom end. The piezoelectric ceramic plates 12, the electrode plate 13 and the metal block 14 are mounted on the shaft portion 22 then fixed to the shaft portion 22 by the nut 15. Thus, a Langevin type ultrasonic transducer UD is constructed.

It is known that the horn portion 23 provides a mechanical impedance matching device for transmitting ultrasonic vibrations from the ultrasonic transducer UD to the rod portion 24 efficiently.

The rod portion 24 is constructed of a hollow cylinder. The ultrasonic vibrations are applied from one end of the horn portion 23 to the rod portion 24. The applied ultrasonic vibrations is spirally transmitted to a tip of the rod portion 24 on the surface of the hollow cylinder. The inner diameter D2 of the rod portion 24 is equal to or more than a half of outer diameter D1.

Vibration voltage is applied to the piezoelectric ceramic plates 12 by an oscillator which is not shown in the Figure. The frequency of the vibration voltage falls, for example, in the 20 kHz–40 kHz range.

It is presumed that the vibrations transmitted to the rod portion 24 act as follows. When ultrasonic vibrations are applied to one end of a cylindrical elastic body (the rod portion 24) and a proper frequency determined by the mass and quantity of the cylindrical elastic body resonates to the frequency of the ultrasonic vibrations, vibrations as shown in FIGS. 3(A) and 3(B) are spirally transmitted from one end to other end of the cylindrical elastic body alternately. The alternate spiral vibrations are superposed in not only circumferential but also longitudinal directions on the surface of the cylindrical elastic body. Accordingly, deformations caused by the alternate vibrations become such that wave motions are spirally transmitted from one end to other end of the cylindrical elastic body.

As shown in FIG. 4, a concave deformation vc appears and a convex deformation vd is appears at the side opposite to the above concave deformation vc on the circumferential surface of the cylindrical elastic body (the rod portion 24) when a part of the circumferential surface is compressed and other part opposite to the compressed surface is expanded by the alternate vibrations va and vb. The deformations appear so as to generate rotations on the circumferential surface of the cylindrical elastic body. Further, a deformation in the longitudinal direction is two-dimensionally added to the above deformations vc and vd. Accordingly, the rotations of the deformations vc and vd on the surface of the cylindrical elastic body are continuously transmitted from the input side end to other side end of the cylindrical elastic body. The deformations vc and vd caused from the alternate vibrations va and vb are spirally transmitted as wave motions.

The cylindrical shaped elastic body does not rotate at that time. However, when one object is in contact with the surface of the cylindrical shaped elastic body, the object is rotated. Further when the object is kept stationary, the object is squeezed by spiral vibrations. In case that the hairs are in contact with the circumferential surface of the cylindrical shaped elastic body, the contacting part of the hairs are squeezed in the circumferential direction by the vibrations of the cylindrical shaped elastic body.

The frequency of the vibration is equal to that one applied to the piezoelectric ceramic plates 12. For example, when vibrating voltage of 28 kHz is applied, the hairs are squeezed 28,000 times per second. As a result, the cross-section of each hair is deformed then the deformation of each hair is remained. Thus, perming is carried out.

The reason why the perming is released to be carried out by the present invention of the perming device will now be explained.

Hair has a medulla in the center, a cortex surrounding the medulla and a cuticle surrounding the cortex. The cortex is made of horny fiber cells which are intertwined like a hemp rope. The space between the cells is filled with inter-cellular filling substances known as keratin C. The cortex consists of eleven constitutions called as protofibrils, each protofibril consists of three constitution fibers, each constitution fiber is made of polypeptide. The cortex of the hair has two different types of characteristic. A distinction of between the two types can be determined by the dyeing method or the like. To explain concretely, one type is A cortex which is easily dyed with acid dye and other type is B cortex which is easily dyed with basic dye. There are various quantities, arrangements, dispositions and intervals concerning these cortexes A and B and determinations of them depend on each individual person. It seems that the cortexes A and B are deformed by the ultrasonic vibrations transmitted from the perming device 1 then the perming is carried on. In particular, it seems that a reversible deformation such as an expansion or a contraction is given to the cortex B rather than the cortex A since the cortex B has the oiliness and the water shedding ability on the other hand the cortex A has the mechanical weaknesses. Consequently, it seems that a permanent waved hair can be made and reset.

Figure 5:
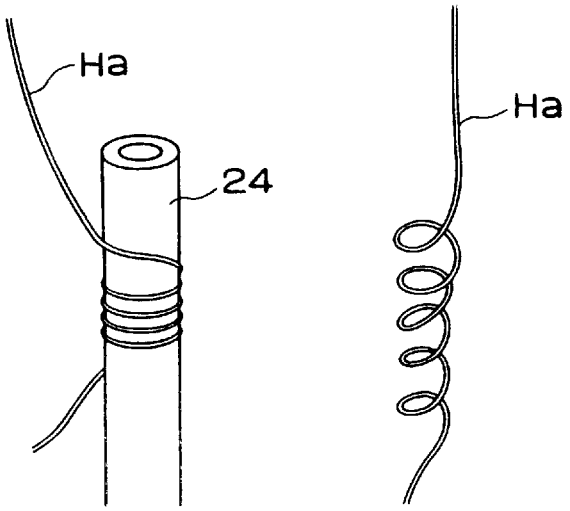
FIG. 5(A) is a drawing showing an example of contact of a hair with the rod.
FIG. 5(B) is a drawing showing an example of a non-contact state of the hair with rod.

FIG. 5(A) is a drawing showing an example of a contact state of hair Ha with the rod portion 24.

As shown in FIG. 5(A), a bundle consisting of a certain number (for example tens) of hairs Ha is spirally wound around the circumferential surface of the rod portion 24 with giving a tension to the hairs. Then ultrasonic vibrations are applied to the rod portion 24 for a few seconds. As shown in FIG. 5(B), the hairs Ha maintain the spiral state even after the hairs Ha are removed from the rod portion 24. Consequently, hair perming can be conducted. In this case, it is supposed that the cross-section of each hair deforms substantially from a circle to an approximate oval.

Figure 6:
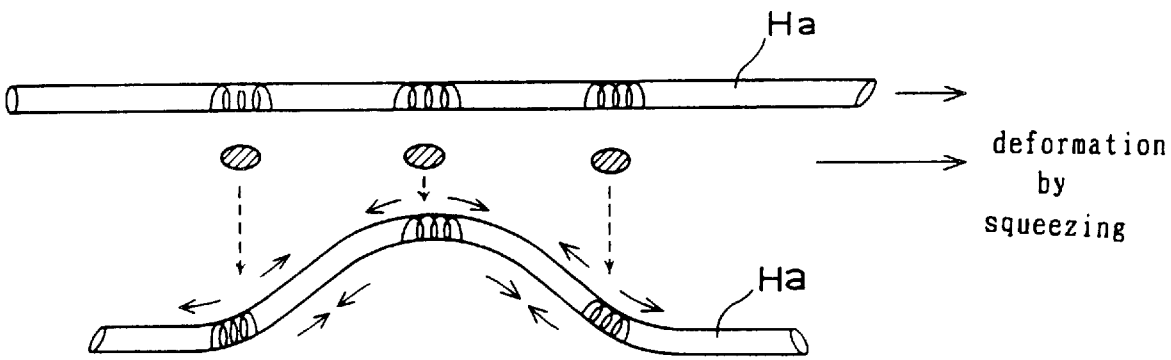
FIG. 6 is a drawing showing an alternation of a hair.

For example as shown in FIG. 6, the cross-section of the hair becomes substantially oval at the bending points.

To perm, one only has to do the following. First, gripping of the metal block 14 and the cylinder portion 21 by hand occurs followed by bringing the hairs into contact with the rod portion 24 so as to make a desired hair style then applying the ultrasonic vibrations to the rod portion 24 for a few seconds. Accordingly, the perming can be conducted very easily in a very short period of time. In addition, there is no damage to hairs and skin since no high heat and no liquid agents are used. Accordingly, customers and hairdressers can permanent waved hair safely not only a beauty parlors but also of home. Also, the hair does not undergo excessive shampooing since static electricity does not charge in the hairs permed by the present invention as much as hairs permed by means of using the perming agents. Accordingly, there is no influence to the social environment caused by a large consumption of water.

Various forms of the permanent waves can be obtained by changing the method of winding the hairs Ha around the rod portion 24, the diameter or the shape of the rod portion 24. Consequently, various types of hairstyle can be made.

On the other hand, waved hair may be made straight when part of the waved hair Ha is pulled under the condition that ultrasonic vibrations are applied to the rod portion 24 and that part of waved hair is in contact with the rod portion 24. In other words, waved hair may be stretched so as to be straight then brought into contact with the rod portion 24 to which the ultrasonic vibrations are applied. The waved hair is then restored to straight hair. Thus, according to the present invention, resetting a hair straight can be conducted very easily in a very short time.

Accordingly, it is possible to change the hair style many times in a day since setting or resetting a hair waved or straight can be easily and repeatedly conducted in a short period of time. it is also possible to perm the hair as easily as changing clothes. Therefore, its applicability extends widely.

Figure 7:
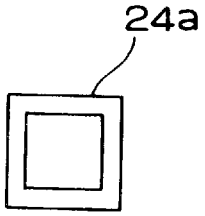
FIG. 7 is a plane view of a rod portion in another embodiment and FIGS. 8(A) and 8(B) are plane views of rod portions in another embodiment.

FIG. 7 is a plane view of the rod portion 24*a* of another embodiment.

This rod portion 24*a* consists of a cylinder having a rectangular cross-section. For example, the hair Ha can be made straight when the waved hair Ha is pulled with keeping in contact with the rod portion 24*a* or when the waved hair is pressed on one of plane surfaces of the rod portion 24*a* with stretch. Thus, the resetting the hair straight can be conducted.

Figure 8:
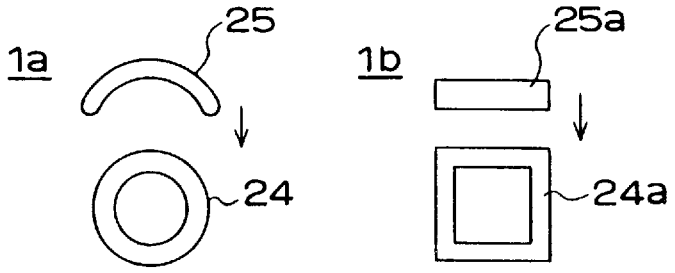

FIGS. 8(A) and 8(B) are plane views of another perming devices 1*a* and 1*b* in further another embodiments.

These perming devices 1*a* and 1*b* are further equipped with guide members 25 and 25*a*. Each guide member has the cross-section including a contour conforming a part of a contour of the cross-section of the rod portion. It is possible to press guide members 25 and 25*a* towards the rod portions 24 and 24*a* respectively. One mechanism can be proposed here which enables the guide members 25 and 25*a* to move to the rod portion 24 and 24*a* in order to press them on the circumferential surfaces of the rod portion 24 and 24*a*. For example, the guide members 25 and 25*a* are mounted on the main body 11 so as to rotate on the main body 11 like scissors.

In the above embodiment, it is necessary to transmit the ultrasonic vibrations from the rod portion 24 to the hairs Ha in order to alter the forms of the hairs Ha. Even if each hair Ha is not in direct contact with the rod portion 24, i.e. even if some of hairs Ha overlap each other, the ultrasonic vibrations are transmitted from the rod portion 24 to each hair Ha then perming is conducted since the hairs can be regarded as quasi-elastic bodies for the ultrasonic vibrations. However, in case the elastic contact of hairs Ha with the rod portion 24 are not sufficient, one only needs to supply the hairs Ha with water. The contact conditions will then be improved. The hairs can be supplied with lotion for hair or a liquid silk protein instead of water. Further, the hairs Ha can be supplied with water or lotion regardless of the contact conditions of the hairs Ha with the rod portion 24. The ultrasonic vibrations of the rod portion 24 cause friction among the hairs Ha wound around the rod portion 24 then the friction generates heat. The heat acts to help perm effectively since the heat is generated in each hair.

The cylinder portion 21, the shaft portion 22, the horn portion 23 and the rod portion 24 are integrally formed as one body in the above embodiment. However, it is possible that each of them or a part of each of them is separately made and are then they are assembled into one body by brazing, soldering, adhering, bolting and the like. When the cylinder portion 21, the shaft portion 22, the horn portion 23 respectively have holes arranged in a line so as to lead to the hollow of the rod portion 24 and a tube is connected to the hole of the shaft portion 22, the hair can be supplied with water or lotion from the tip of the rod portion 24. In the above embodiment, highly elastic materials, especially, the highly elastic materials having a characteristic of high sound velocity are preferable as the rod portion 24. Copper alloy is not suitable for perming because undesirable substances precipitate.

In the above embodiment, the shape and dimension of the rod portion 24 can be changed variously. For example, the perming of the eyelashes can be easily conducted by reducing the diameter D1 of the rod portion 24. The construction and figure of the ultrasonic transducer UD, the number of the piezoelectric ceramic plates 12 and the frequency of ultrasonic vibrations can be variously changed.

The perming device is constructed so as to be portable in the above embodiment. However, the perming device also can be constructed so as to be stationary. For example, the perming can be conducted when many perming devices are disposed around an upper end of a chair in a beauty parlor and one customer sits on the chair. Then all hairs some hair of the customer is set by the present perming devices. As a result, all of the hair of the customer can be permed at the same time.

As described above, the present invention of the perming method and device can perm hair very easily and safely in a very short time without damaging hair and skin. Accordingly, the invention is useful for perming.

I claim:

1. A perming method for altering hairs, comprising the steps of:

pressing hairs directly onto a surface of a cylindrically shaped elastic body; and spirally transmitting ultrasonic vibrations to said elastic body.

2. A perming device, comprising:

a rod having a cylindrical shaped elastic body to which hairs are directly pressed;

a horn elastically coupled with said rod and;

an ultrasonic transducer which is elastically coupled with said horn and which spirally transmits ultrasonic vibrations to the elastic body through the rod.

3. The perming device as claimed in 2, wherein said ultrasonic transducer is comprises a Langevin type ultrasonic transducer.

4. The perming device as claimed in claim 2, further comprising a guide member which has a cross-section including a contour conforming to a part of a contour of the cross-section of said rod and which is pressed towards a circumferential surface of said rod.

5. The perming device as claimed in claim 2, wherein said rod and said horn are integrally formed.

6. The perming device as claimed in claim 2, wherein a cross-section of said rod is substantially rectangular.

7. The perming device as claimed in claim 6, wherein said ultrasonic transducer comprises a Langevin type ultrasonic transducer.

8. The perming device as claimed in claim 6, further comprising a guide member which has a cross-section having a contour conforming to a part of a contour of the cross-section of said rod and which is pressable towards a circumferential surface of said rod portion.

9. The perming device as claimed in claim 2, wherein a cross-section of said rod is substantially annular.

10. The perming device as claimed in claim 9, wherein said ultrasonic transducer is constructed as a Langevin type ultrasonic transducer.

11. The perming device as claimed in claim 9, further comprising a guide member which has a cross-section including a contour conforming to a part of a contour of the cross-section of said rod and which is pressable towards a circumferential surface of said rod portion.

12. The perming device as claimed in claim 9, wherein an inner diameter of said annular rod is equal to or greater than half of an outer diameter of the annular rod.

13. The perming device as claimed in claim 12, wherein said ultrasonic transducer is constructed as a Langevin type ultrasonic transducer.

14. The perming device as claimed in claim 12, further comprising a guide member which has a cross-section having a contour conforming to a part of a contour of the cross-section of said rod and which is pressable towards a circumferential surface of said rod portion.

* * * * *